US006026592A

United States Patent [19]

Herr

[11] Patent Number: 6,026,592

[45] Date of Patent: Feb. 22, 2000

[54] DRYING RACK WITH ELECTRONIC CONTROL

[75] Inventor: Joel L. Herr, Newton, Iowa

[73] Assignee: Maytag Corporation, Newton, Iowa

[21] Appl. No.: 09/078,169

[22] Filed: May 13, 1998

[51] Int. Cl.[7] ..... F26B 3/00

[52] U.S. Cl. ..... 34/446; 34/550; 34/600

[58] Field of Search ..... 34/380, 381, 427, 34/446, 476, 486, 494, 499, 550, 90, 94, 600, 608, 610, 237, 238; 318/799, 433, 483; D32/58, 59; 223/51, 52, 57

[56] References Cited

U.S. PATENT DOCUMENTS

| | | | |
|---|---|---|---|
| D. 314,262 | 1/1991 | Kretchman et al. . | |
| 3,316,659 | 5/1967 | Lauck . | |
| 3,724,095 | 4/1973 | Laue et al. . | |
| 4,091,548 | 5/1978 | Daily . | |
| 4,109,397 | 8/1978 | Daily . | |
| 4,525,937 | 7/1985 | Strandberg, Jr. et al. | 34/550 |
| 4,617,743 | 10/1986 | Barnard . | |
| 4,677,760 | 7/1987 | St. Louis . | |
| 4,788,775 | 12/1988 | Ahmed | 34/552 |
| 4,827,627 | 5/1989 | Cardoso | 34/526 |
| 4,908,959 | 3/1990 | Kretchman et al. . | |
| 5,101,575 | 4/1992 | Bashark | 34/562 |
| 5,276,979 | 1/1994 | Gordon, Sr. . | |
| 5,333,393 | 8/1994 | Hill et al. . | |
| 5,365,675 | 11/1994 | Shabram, Jr. . | |
| 5,755,041 | 5/1998 | Horwitz | 34/491 |

*Primary Examiner*—Henry Bennett
*Assistant Examiner*—Steve Gravini
*Attorney, Agent, or Firm*—Zarley, McKee, Thomte, Voorhees & Sease

[57] ABSTRACT

A stationary drying rack of the present invention is used in a clothes dryer for drying articles of clothing which cannot be tumbled by the dryer. The stationary rack is capable of using the electronic control drying circuitry of the dryer by making electrical contact with the sensor bars of the dryer and providing additional sets of sensor bars disposed on the drying rack. As a result, the sensor bars on the drying rack are electrically connected to the sensor bars on the dryer.

13 Claims, 4 Drawing Sheets

DRYING RACK WITH ELECTRONIC CONTROL

BACKGROUND OF THE INVENTION

1. Field of the Invention

The present invention relates to clothes dryers. More particularly, though not exclusively, the present invention relates to a drying rack accessory for a clothes dryer.

2. Problems in the Art

There are various devices known in the art used to support delicate items which, because of their delicate nature, cannot be subjected to the normal tumbling action of a clothes dryer. A typical prior art device is comprised of a drying rack which is supported within the dryer but remains stationary, rather than rotating with the tumbler of the dryer. Therefore, items placed upon the rack are subjected to the heat of the dryer, but are not tumbled with the rotating tumbler.

Typical prior art clothes dryers are equipped with electronic drying control circuitry. A typical prior art drying control is comprised of a pair of sensing bars disposed within the drying chamber. As wet articles pass over the sensor bars, contact is made between the two sensor bars which is registered by a dryness circuitry which in turn prevents the timer from advancing toward the off position. The sensor bars are typically electrically in series with each other. One of the sensor bars is grounded while the other is connected to the dry control circuitry.

One disadvantage of a drying rack such as that mentioned above is that the electronic dry control circuitry will not function since the clothing is not passed over the sensor bars as normally happens when the clothing tumbles within the dryer.

3. Features of the Invention

A general feature of the present invention is the provision of a method and apparatus for providing an electronic control drying rack which overcomes problems found in the prior art.

A further feature of the present invention is the provision of a method and apparatus for providing an electronic control drying rack which provides a set of sensor bars disposed on a stationary drying rack and electrically connected to the dryer's sensor bars.

Further features, objects and advantages of the present invention include:

- A method and apparatus for providing an electronic control drying rack which includes a plurality of sensor bars disposed in a spaced relation on the drying rack.
- A method and apparatus for providing an electronic control drying rack which uses a rack which is supported at each end by the tumbler front and tumbler back in order to remain stationary.
- A method and apparatus for providing an electronic control drying rack which includes a connector pad for making electrical contact between the sensor bars on the drying rack and the dryer's sensor bars.
- A method and apparatus for providing an electronic control drying rack which extends the contacts of the dryer's sensor bars.
- A method and apparatus for providing an electronic control drying rack which extends the contacts of the dryer's dry control system to a stationary drying rack for nontumbling loads.

These as well as other features, objects and advantages of the present invention will become apparent from the following specification and claims.

SUMMARY OF THE INVENTION

The drying rack of the present invention is used in a clothes dryer for drying articles of clothing without having the clothing tumbled by the dryer. The drying rack is adapted to be placed within the dryer such that the rack will remain stationary during the tumbling operation. One or more sets of sensor bars are disposed on the drying rack and are electrically connected to the sensor bars on the dryer such that the electronic control drying circuitry of the dryer can be used while the stationary rack is used.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalencies which may be included within the spirit and scope of the invention.

Figure 1:
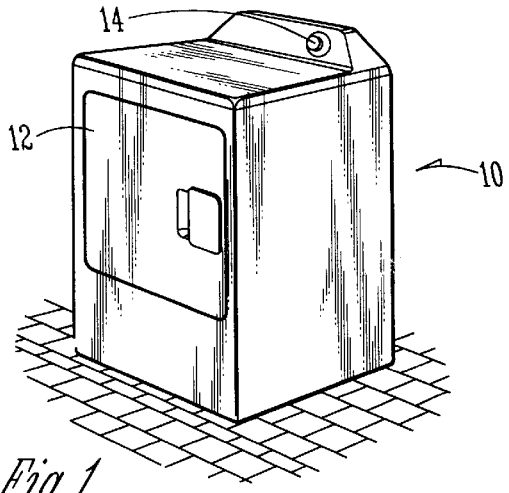
FIG. 1 is a perspective view of a clothes dryer of the present invention.
Figure 2:
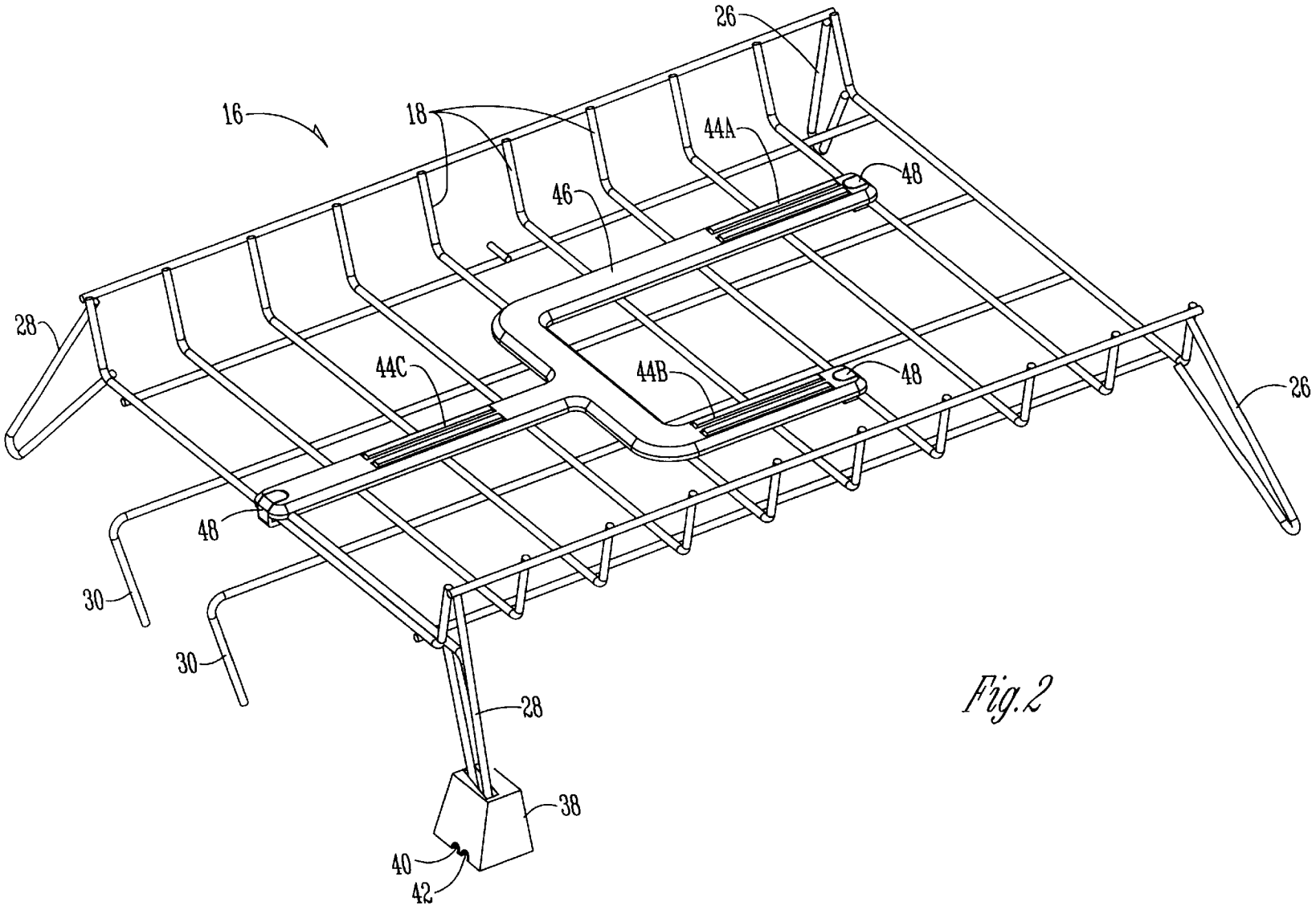
FIG. 2 is a perspective view of a drying rack of the present invention.

FIG. 1 shows a clothes dryer 10 of the present invention including an access door 12 and a control panel 14. FIG. 2 is a view showing a drying rack 16 of the present invention. The drying rack 16 includes a number of metal rods 18 which are preferably welded together and covered with a plastic coating. Alternatively, the drying rack could be made from plastic.

Figure 3:
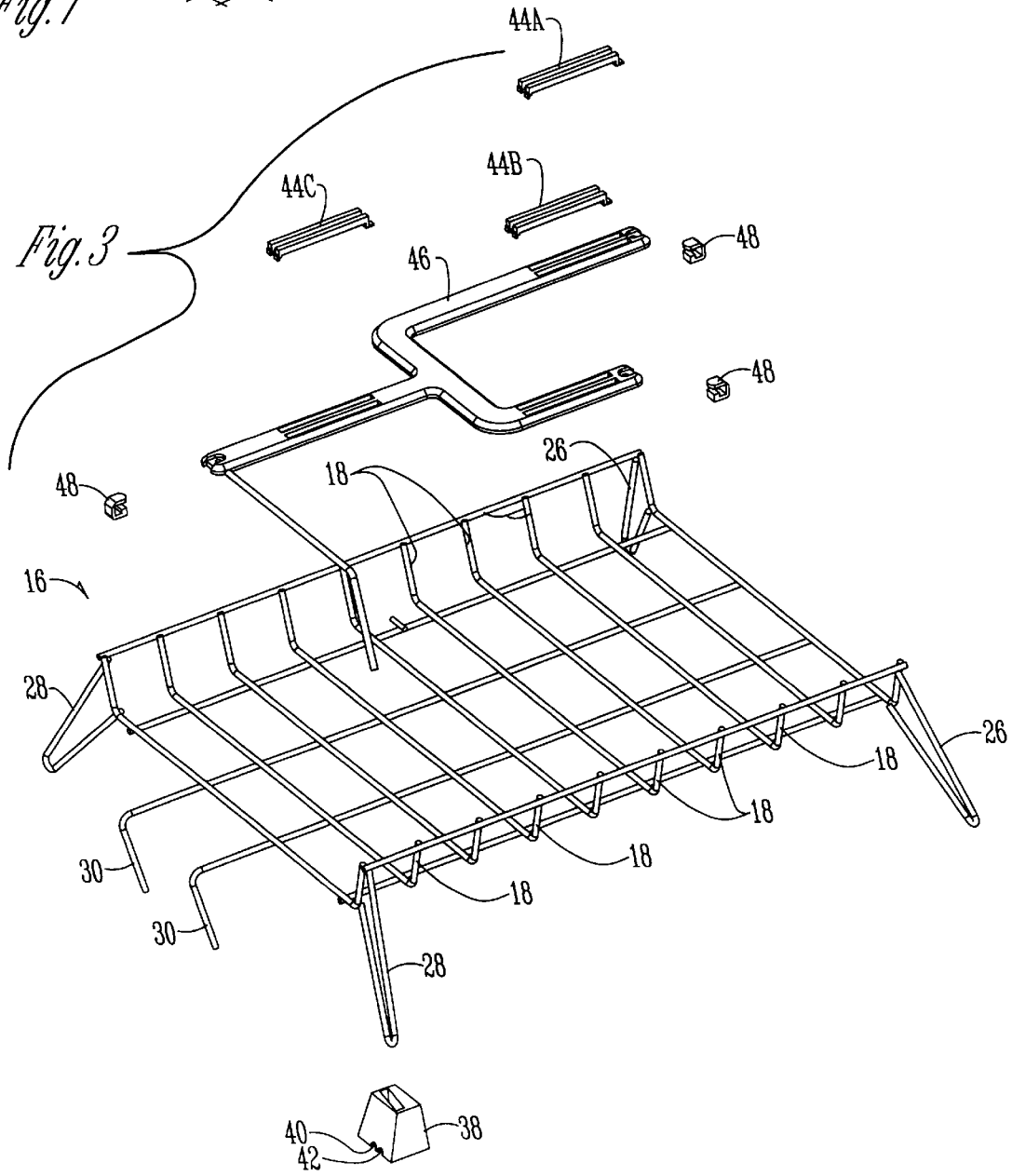
FIG. 3 is an exploded view of the dryer rack shown in FIG. 2.
Figure 4:
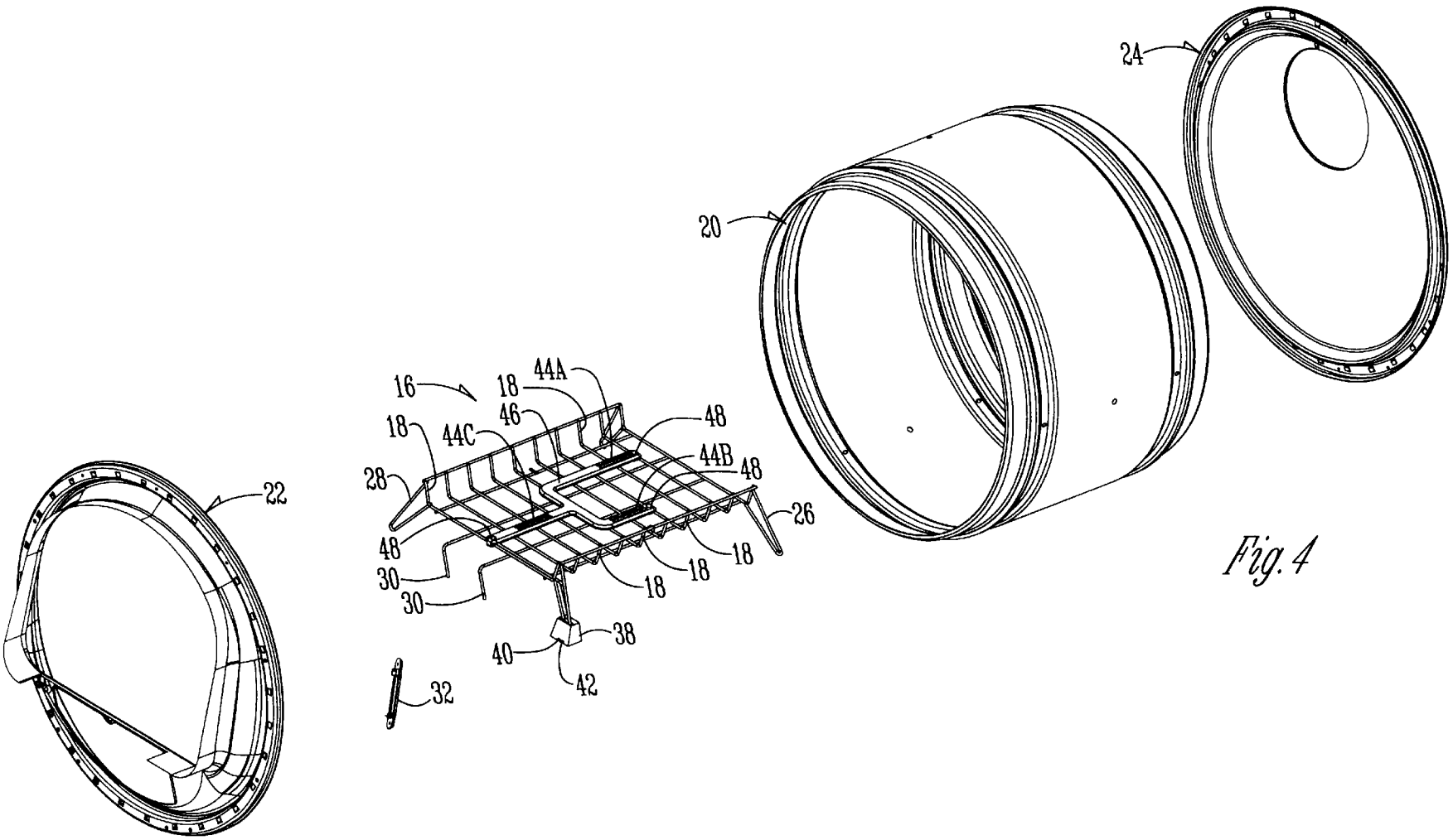
FIG. 4 is a view of the drying rack of the present invention along with the dryer tumbler in an exploded view.

FIG. 3 shows the drying rack 16 in an exploded view. FIG. 4 shows the drying rack 16 along with a tumbler 20 in an exploded view. The tumbler 20 is cylindrically shaped and includes a tumbler front 22 and a tumbler back 24. When the dryer 10 is drying clothes, the tumbler 20 rotates in order to tumble the clothes within the dryer 10. The tumbler front 22 and tumbler back 24 remain stationary while the tumbler 20 rotates.

The drying rack 16 is adapted to fit within the dryer 10 and is supported at the ends by the tumbler back 24 and the tumbler front 22 and the drying rack 16 does not rotate with the tumbler 20. The drying rack 16 includes a pair of back legs 26 which rest on the tumbler back 24. The dryer rack 16 also has a pair of front legs 28 which rest upon the tumbler front 22. In addition, a pair of hooks 30 are adapted to rest on the tumbler front 22 to help position the drying rack 16. When the drying rack 16 is installed as described, and the tumbler 20 rotates, the drying rack 16 remains stationary. Therefore, clothes placed on the drying rack 16 will not tumble within the dryer 10 but will still be dried by the heat within the dryer 10.

Figure 5:
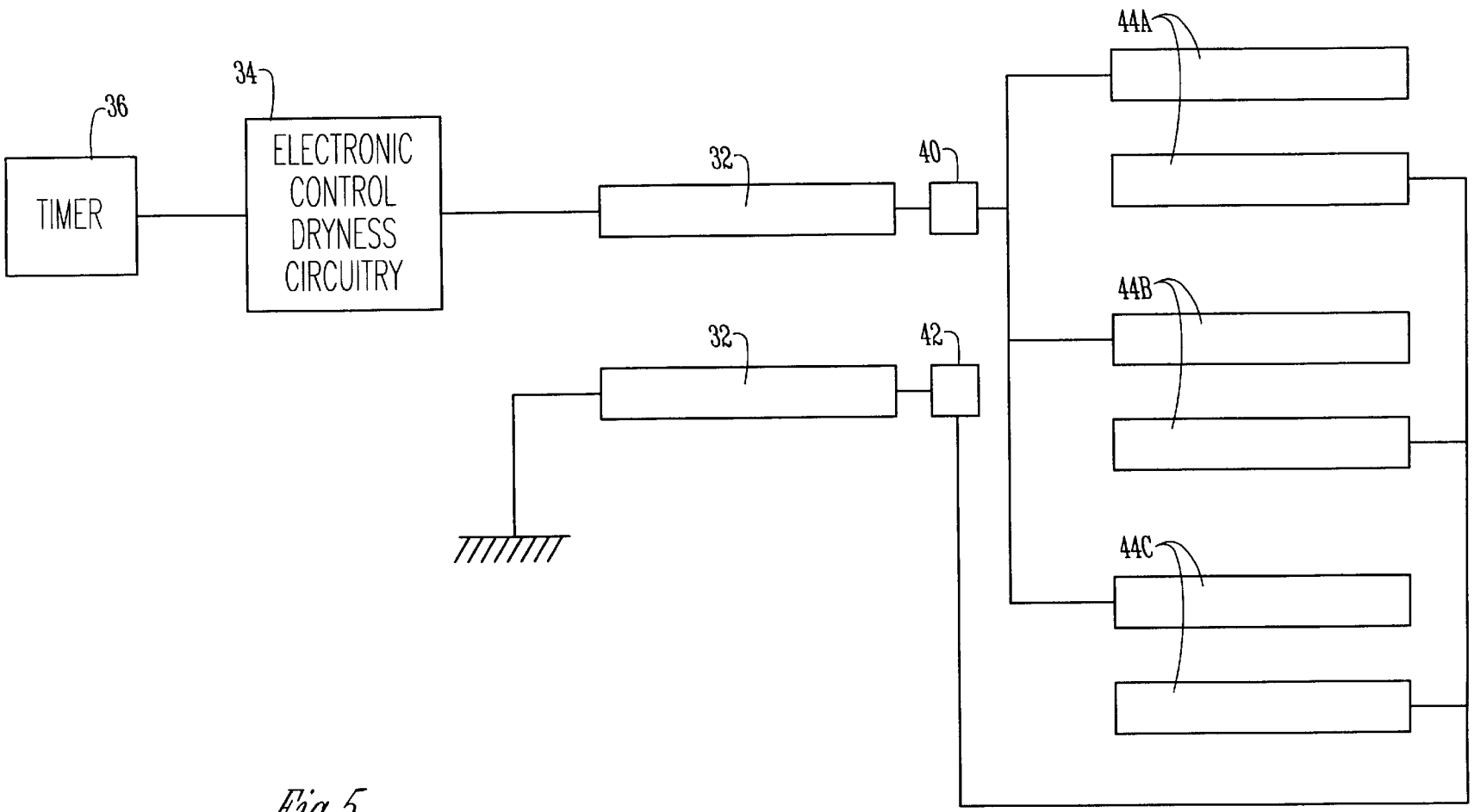
FIG. 5 is a schematical block diagram of the electronic control drying rack of the present invention.

As described above, conventional dryers include a pair of sensor bars 32 which are typically mounted on the tumbler front 22. As clothes are tumbled within the dryer 10, the clothing will periodically pass over the sensor bars 32 and the dryness of the clothing is determined by the dry control circuitry. FIG. 5 is a schematic block diagram showing the sensor bars 32 on a typical dryer 10. As shown, one of the sensor bars 32 is connected to ground while the other is connected to the electronic control dryness circuitry 34 which is connected to a timer 36 which controls the operation of the dryer 10.

As mentioned above, one problem with prior art drying racks is that the sensor bars 32 are basically non-functional since clothing placed on the drying rack 16 will never pass over the sensor bars 32. The drying rack 16 of the present invention includes a connector pad 38 which includes two contacts 40 and 42 which are shaped and positioned to electrically connect to the sensor bars 32 when the drying rack 16 is placed within the dryer 10. The connector pad 38 is electrically connected to three sets of sensor bars 44A, 44B and 44C which are formed on a control pad 46. The control pad 46 is attached to the rods 18 by three clasp pads 48. The sensor bars 44A, 44B and 44C are preferably arranged in the positions shown in the figures, although the sensor bars 44A, 44B and 44C could be placed at various locations on the drying rack 16. In addition, more or less sets of sensor bars could be positioned on the drying rack 16. FIG. 5 illustrates how the sensor bars 44A, 44B and 44C are wired to the sensor bars 32. As shown, the sensor bars are wired in parallel to the sensor bars 32. The sensor bars 44A, 44B and 44C therefore act as extensions to the sensor bars 32 such that the clothing placed on the drying rack 16 can be sensed for dryness.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A stationary drying rack for use with a clothes dryer having electronic control drying circuitry and a set of sensor bars for sensing the dryness of clothing contacting the sensor bars, the stationary drying rack comprising:

a drying rack adapted to be placed within the dryer such that the rack will remain substantially stationary within the dryer; and a second set of sensor bars disposed on the drying rack and electrically connected to the set of sensor bars on the dryer.

2. The stationary drying rack of claim 1 wherein the second set of sensor bars is comprised of a plurality of sensor bars with pairs of the second set being electrically connected in parallel to each other.

3. The stationary drying rack of claim 1 further comprising a connector pad coupled to the drying rack for making electrical contact with the set of sensor bars of the dryer when the drying rack is placed within the dryer.

4. The stationary drying rack of claim 1 wherein the second set of sensor bars is electrically connected in parallel to the set of sensor bars on the dryer.

5. The stationary drying rack of claim 1 further comprising third and fourth sets of sensor bars disposed on the drying rack, wherein the second, third and fourth sets of sensor bars are electrically connected to each other in parallel.

6. A method of sensing the dryness of clothing placed on a stationary drying rack within a clothes dryer having electronic control drying circuitry and a set of sensor bars for sensing the dryness of clothing contacting the sensor bars, the method comprising the steps of:

placing a second set of sensor bars on the stationary drying rack; and electrically connecting the second set of sensor bars to the set of sensor bars on the dryer.

7. The method of claim 6 further comprising the step of placing a connector pad over the set of sensor bars of the clothes dryer to electrically connect the second set of sensor bars to the set of sensor bars on the dryer.

8. The method of claim 6 further comprising the step of placing a plurality of sets of sensor bars on the stationary drying rack and electrically connecting the plurality of sets of sensor bars to the set of sensor bars on the dryer.

9. The method of claim 8 further comprising the step of arranging the plurality of sets of sensor bars in a space relation to provide sensing points at various locations on the drying rack.

10. A drying rack for use with a clothes dryer having electronic control drying circuitry comprising:

a rack adapted to be placed within the dryer; and a sensor disposed on the rack for sensing the dryness of clothing placed on the rack, the sensor being electrically connected to the electronic control drying circuitry.

11. The drying rack of claim 10 wherein the rack remains stationary during the operation of the dryer.

12. The drying rack of claim 10 wherein the sensor is comprised of two or more electrically conductive contacts for sensing the dryness of clothing placed over the sensor by sensing the conductivity of the clothing.

13. The drying rack of claim 10 wherein the clothes dryer includes a pair of sensor bars for sensing the dryness of clothing during the normal operation of the dryer, and wherein the sensor is electrically connected to the electronic control drying circuitry through the set of sensor bars.

* * * * *